United States Patent [19]

Rothmeier et al.

[11] 4,386,495

[45] Jun. 7, 1983

[54] DOUBLE TWISTING SPINDLE WITH A PNEUMATICALLY OPERATED THREADING DEVICE

[75] Inventors: Waldemar Rothmeier; Rolf-Dieter Weber, both of Kempten, Fed. Rep. of Germany; Zdenek Hemala, deceased, late of Durach, Fed. Rep. of Germany, by Jirina Hemala, Michal Hemala, Martin Hemala, legal representatives

[73] Assignee: Saurer-Allma GmbH, Kempton, Fed. Rep. of Germany

[21] Appl. No.: 240,707

[22] Filed: Mar. 5, 1981

[30] Foreign Application Priority Data

Mar. 31, 1980 [DE] Fed. Rep. of Germany ..... 8008865

[51] Int. Cl.[3] ..... D01H 15/00; D01H 7/86

[52] U.S. Cl. ..... 57/279; 57/58.83; 57/88

[58] Field of Search ..... 57/58.49, 58.7, 58.83, 57/58.86, 279, 280, 88, 89

[56] References Cited

U.S. PATENT DOCUMENTS

| | | | |
|---|---|---|---|
| 3,166,882 | 1/1965 | Stahlecker | 57/88 |
| 3,731,478 | 5/1973 | Franzen | 57/58.7 |
| 3,805,504 | 4/1974 | Franzen | 57/279 X |
| 4,168,605 | 9/1979 | D'Agnolo | 57/279 |
| 4,287,712 | 9/1981 | Franzen | 57/58.86 X |

*Primary Examiner*—John Petrakes

*Attorney, Agent, or Firm*—Flynn, Thiel, Boutell & Tanis

[57] ABSTRACT

A double twisting spindle is equipped with a pneumatically operated threading device. An injector nozzle is provided in the spindle rotor, an air stream through which nozzle sucks a thread into a hollow spindle axle and moves the thread through a thread channel in the storage plate. A compressed-air supply device is arranged below the spindle rotor for supplying compressed air to a central connecting channel provided in the spindle rotor and in communication with the injector nozzle. A common operating lever is provided which first operates a spindle brake and then opens a valve of the compressed-air supply device. The connecting channel has at its open lower end a funnel-shaped enlargement. The compressed-air supply device is stationary and has a blow nozzle which is fixedly arranged a small distance from the lower end of the spindle rotor and has an outlet opening which is coaxial with the funnel-shaped portion, the diameter of the outlet opening being smaller than the inlet diameter of the funnel-shaped portion.

7 Claims, 2 Drawing Figures

DOUBLE TWISTING SPINDLE WITH A PNEUMATICALLY OPERATED THREADING DEVICE

FIELD OF THE INVENTION

This invention relates to a double twisting spindle having a pneumatically operated threading device including an injector nozzle provided in the spindle rotor, an air stream through which nozzle sucks a thread into a hollow spindle axle and moves the thread through a thread-guiding channel of a storage plate, including a compressed-air supply device which is arranged below the spindle rotor for supplying compressed air to a central connecting channel which is provided in the spindle rotor and communicates with the injector nozzle, and including a common operating lever which first operates a spindle brake and then opens a valve of the compressed-air supply device.

BACKGROUND OF THE INVENTION

In one such conventional double twisting spindle (German OS No. 20 35 025 which corresponds to U.S. Pat. No. 3,731,478), the compressed-air supply device consists of a hollow conduit which is movable parallel to the spindle axis, the upper free end of which conduit carries a seal and the lower end of which is connected to a diaphragm arranged in a housing. A valve initially tensioned by a spring is provided in the diaphragm. The housing is connected to a compressed-air source through a valve which is operated by a hand lever. When the hand lever is operated, the spindle rotor is stopped by a suitable braking mechanism which is not disclosed in detail. Upon further operation of the hand lever, the valve is opened and compressed air flows into the housing. The hollow conduit is urged by the compressed air against the lower end of the spindle rotor. When the compressed air in the housing exceeds a certain pressure, the check-valve opens and the compressed air flows into the connecting channel of the spindle rotor.

This arrangement is relatively expensive, because a movable hollow conduit, a diaphragm and a housing must be provided for every spindle. Furthermore, a second compressed-air cylinder for operating the spindle brake probably must also be provided.

A basic purpose of the invention is therefore to provide a double twisting spindle having a pneumatically operated threading device of the abovementioned type which is simpler in design and less expensive to manufacture than known devices.

SUMMARY OF THE INVENTION

This is achieved according to the invention by the connecting channel in the spindle rotor having at its open lower end a funnel-shaped portion and the compressed-air supply device being stationary and having a blow nozzle fixedly arranged a small distance from the lower end of the spindle rotor with an outlet opening which is coaxial to the funnel-shaped portion, the diameter of the outlet opening being smaller than the inlet diameter of the funnel-shaped portion.

This design provides the double twisting spindle with a pneumatically operated threading device which is substantially simpler in structure than known devices. All parts of the compressed-air supply device, with the exception of the valve, are stationary. The movable conduit, the diaphragm and the housing for the movable support of the movable conduit can be omitted. With this, the double twisting spindle not only becomes simpler in structure, but also has smaller physical dimensions. Due to the special construction of the lower end of the spindle rotor, the compressed air which exits from the blow nozzle enters the spindle rotor without the interpositioning of a seal, yet without great compressed-air losses. Since moving parts are substantially omitted, the new double twisting spindle is less susceptible to trouble and needs less servicing.

A particularly advantageous development of the invention is characterized by the operating lever being a substantially vertical one-arm foot lever which is pivotal at its upper end about a horizontal axis extending in the longitudinal direction of the machine and by the spindle brake and the valve each having an operating member movable in a direction substantially perpendicular to the spindle axis and to the foot lever, the operating member for the spindle brake being arranged a smaller distance from the upper end of the foot lever than the operating member for the valve and cooperating with the foot lever as or through an interpositioning spring arrangement, and the operating member for the valve being arranged spaced from the foot lever in the rest position of same.

With this relatively simple arrangement, a properly sequenced braking of the spindle and operating of the threading device is possible. A single foot lever acts directly and successively onto the operating member for the spindle brake and then the operating member for the valve. Through an easy operation of the foot lever, the spindle brake functions first. Then, upon further pressure onto the foot lever, the valve is also opened and compressed air enters the connecting channel of the spindle rotor.

BRIEF DESCRIPTION OF THE DRAWINGS

The invention will be described in greater detail hereinafter in connection with two exemplary embodiments which are illustrated in the drawings, in which.

DETAILED DESCRIPTION

Figures 1, 2:
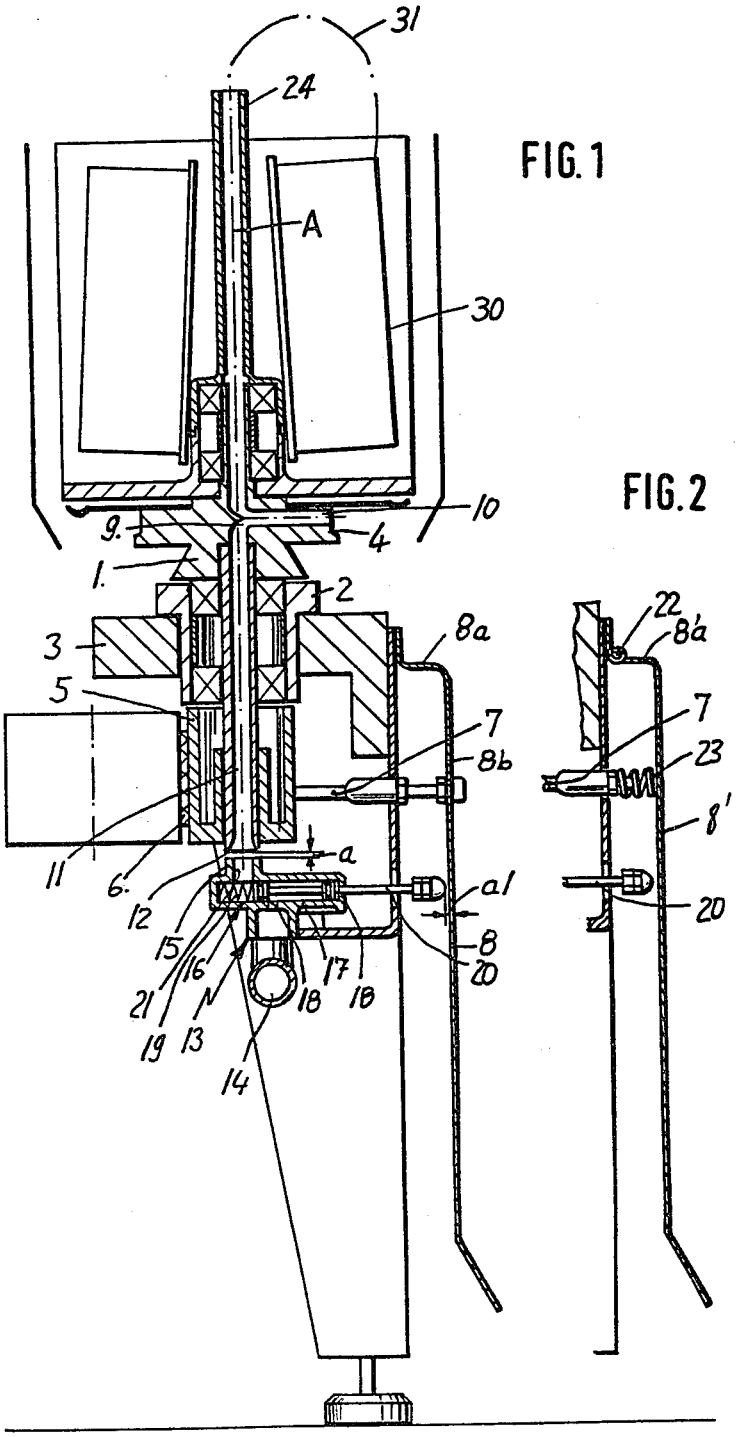
FIG. 1 is a cross-sectional side view of a first exemplary embodiment.
FIG. 2 is a cross-sectional side view of part of a second exemplary embodiment.

A spindle rotor 1 is supported rotatably about the axis 14 in a bearing housing 2 which in turn is secured in the spindle rail 3. The spindle rotor 1 carries a storage plate 4 and a whorl 5 which can be driven by means of a tangential belt 6. A bobbin 30 of conventional construction is supported on the storage plate 4 in a conventional manner, and a length of thread 31 is wound on the bobbin 30. A spindle brake can engage the spindle whorl 5, which brake is not illustrated in detail and is constructed as an external shoe brake. An operating member 7 for the spindle brake can be moved horizontally and vertically with respect to a foot lever 8. An injector nozzle 9 is provided in the spindle rotor 1, and the outlet opening of the injector nozzle 9 communicates with a thread outlet channel 10 in the storage plate 4. The injector nozzle 9 communicates with a central vertical connecting channel 11 in the spindle rotor 1. The central connecting channel 11 has at its lower end a downwardly opening funnel-shaped portion 12. A compressed-air supply device 13 is arranged stationarily below the spindle rotor 1 and is connected to a compressed-air pipeline 14. The compressed-air supply device 13 has a blow nozzle 15 which is located a small distance "a" below the lower end of the channel 11 in the spindle rotor 1. Furthermore, the compressed-air supply device 13 contains a valve 16 which includes two control pistons 18 movable in a housing 17 and a return spring 19. An operating member 20 is provided to operate the control pistons 18.

The compressed air pipeline 14 is connected to a conventional and not-illustrated source of compressed air. The control pistons 18 are mounted at spaced locations on the operating member 20 for the valve 16, and the spring 19 urges the operating member 20 of FIG. 1 rightwardly toward a closed position in which the pistons 18 inhibit movement of compressed air from the pipeline 14 through the valve 16. If the operating member 20 of FIG. 1 is moved leftwardly against the urging of the spring 19, a position is reached in which compressed air passes from the pipeline 14 through the valve 16 to the blow nozzle 15.

The foot lever 8 is constructed as a leaf spring in the exemplary embodiment of FIG. 1. The foot lever 8 is preferably constructed with not illustrated bends, beads or the like so that it is relatively stiff below the operating member 20 for the valve 16 but is elastically flexible above the operating member 20. Due to this design, the foot lever 8 may, in effect, be conceptually considered to be supported pivotally at its upper end for movement about a horizontal axis which extends in the longitudinal direction of the machine. Simultaneously, the leaf spring 8 functions as would a spring interpositioned between the operating member 7 for the shoe brake and the foot lever 8. The foot lever 8 is connected at its upper end 8*a* to the spindle rail 3. The operating member 7 for the spindle brake is movable horizontally and vertically with respect to the foot lever 8.

The threading operation takes place according to the following description.

In the rest position of the foot lever 8, the operating member 20 for the valve 16 is arranged at a distance "al" from the foot lever 8. Through a gentle operation of the foot lever 8, the operating member 7 of FIG. 1 is moved to the left, the spindle brake starts to function and the spindle rotor 1 is stopped. Further pressure onto the foot lever 8 moves the operating member 20 for the valve 16 to the position in which the control pistons 18 allow compressed air to pass through the valve 16 to the outlet opening 21 of the blow nozzle 15. Since the operating member 7 cannot be moved any further to the left when the braking shoes rest on the whorl 5, the foot lever 8 will have been elastically bent in its areas which lies above the operating member 20. Compressed air now flows from the outlet opening 21 into the connecting channel 11. Since the diameter of the outlet opening 21 is smaller than the greatest diameter of the funnel-shaped portion 12, and since the mouth of the blow nozzle 15 is arranged only a small distance above the lower end of the spindle rotor 3, compressed-air losses are substantially avoided. The compressed air which enters the connecting channel 11 flows through the injector nozzle 9 and produces a vacuum in the upright hollow spindle shaft 24. Through this, a thread present at the upper end of the hollow spindle shaft 24 is sucked downwardly into the channel therein and blown outwardly through the outlet channel 10 in the storage plate 4. After the threading operation is finished and the foot lever 8 is released, the valve 16 closes again under the urging of the restoring spring 19.

The operating members 7 and 20 for the spindle brake and the valve 16 can be adjusted advantageously, for example through setscrews and adjusting nuts, so that, upon operation of the foot lever 8, the spindle rotor 1 always stops first and only then is the valve 16 opened.

In the second exemplary embodiment which is illustrated in FIG. 2, the foot lever 8' is constructed rigidly and is pivotally supported at its upper end 8'*a* on an axle 22 which extends in the longitudinal direction of the machine. A compression spring 23 is arranged between the foot lever 8' and the operating member 7. The remaining parts correspond in structure and function with the first exemplary embodiment described above and further discussion with respect thereto is not needed.

Through a gentle operating of the foot lever 8' the spring 23 moves the operating member 7 to the left, the spindle brake starts to function and the spindle rotor 1 is stopped. Further pressure onto the foot lever 8 moves the operating member 20 for the valve 16 to its open position in which compressed air passes to the outlet opening 21. Since the operating member 7 cannot be moved any further to the left when the braking shoes rest on the whorl, the spring 23 will have been elastically compressed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A double twisting spindle having a pneumatically operated threading device, comprising a frame means, a spindle rotor rotatably mounted on said frame means about an axis of rotation and having an injector nozzle means and an outlet means therefrom, a thread outlet channel communicating with said outlet means of said injector nozzle means, an elongated and hollow spindle shaft centrally connected to said spindle rotor on one side thereof, the interior of said hollow spindle shaft communicating with said injector nozzle means, an elongated and hollow connecting channel centrally connected to said spindle rotor on a side thereof remote from said spindle shaft, the interior of said connecting channel communicating with said injector nozzle means, the end of said connecting channel remote from said injector nozzle means being flaired outwardly to define a funnel-shaped portion, the longitudinal axes of said spindle shaft and said connecting channel coinciding with the axis of rotation of said spindle rotor, and compressed air supply means having a blow nozzle axially aligned with said connecting channel and spaced axially therefrom to define a gap between said blow nozzle and said funnel-shaped portion, said compressed air supply means being stationarily affixed to said frame means, the diameter of the outlet opening of said blow nozzle being smaller than the inlet diameter of the funnel-shaped portion, whereby air supplied to said funnel-shaped end of said connecting channel from said outlet opening of said compressed air supply means will cause a thread to be drawn into the interior of said spindle shaft and delivered to said thread outlet channel.

2. The spindle according to claim 1, wherein said compressed air supply means includes an operating lever means which is a one-arm, substantially vertical lever pivotal about means defining a horizontal axis at its upper end, said operating lever means including means for sequentially activating a spindle brake and a valve in response to a pivoting of said lever, the location of said means for activating said spindle brake being arranged a lesser distance from said horizontal axis than said means for activating said valve, and wherein in the rest position of said lever said means for activating said valve is spaced from said lever.

3. The spindle according to claim 2, wherein said means for activating said valve and said spindle brake are horizontally movable.

4. The spindle according to claim 3, wherein said valve has control pistons which are movable horizontally in a housing against the force of a spring.

5. The spindle according to claim 2, wherein said lever is an elongated leaf spring.

6. The spindle according to claim 2, wherein said lever is constructed rigidly and between it and said means for activating said spindle brake there is arranged a compression spring.

7. The spindle according to one of the claims 2–6, wherein said means for activating said valve and said spindle brake are operating members which are adjustable with respect to said lever, and wherein said lever is a foot actuated lever.

* * * * *